US005368446A

United States Patent [19]

Rode

[11] Patent Number: 5,368,446

[45] Date of Patent: Nov. 29, 1994

[54] SCROLL COMPRESSOR HAVING HIGH TEMPERATURE CONTROL

[75] Inventor: Donald W. Rode, St. Paris, Ohio

[73] Assignee: Copeland Corporation, Sidney, Ohio

[21] Appl. No.: 7,770

[22] Filed: Jan. 22, 1993

[51] Int. Cl.[5] ..... F04B 49/02; H02K 11/00; H02H 7/08

[52] U.S. Cl. ..... 417/18; 417/32; 310/68 C

[58] Field of Search ..... 417/32, 18; 310/68 C

[56] References Cited

U.S. PATENT DOCUMENTS

| | | | |
|---|---|---|---|
| 2,518,597 | 8/1950 | Brooks | 417/32 |
| 2,940,395 | 6/1960 | Hill | 417/32 |
| 3,232,519 | 2/1966 | Long | 417/32 |
| 3,278,111 | 10/1966 | Parker | 417/32 |
| 4,236,092 | 11/1980 | DiFlora . | |
| 4,503,347 | 3/1985 | Bergman . | |
| 4,820,130 | 4/1989 | Eber et al. | 417/32 |
| 4,926,081 | 5/1990 | DiFlora et al. . | |
| 4,955,795 | 9/1990 | Griffith | 417/44 |
| 5,076,067 | 12/1991 | Prenger et al. . | |
| 5,118,260 | 6/1992 | Fraser, Jr. . | |
| 5,141,407 | 8/1992 | Ramsey et al. . | |
| 5,200,872 | 4/1993 | D'Entremont et al. | 417/32 |

*Primary Examiner*—John J. Vrablik

*Attorney, Agent, or Firm*—Harness, Dickey & Pierce

[57] ABSTRACT

A thermal protection system for a scroll compressor has a temperature sensor which is positioned directly within the discharge passage of the scroll compressor by being directed through an access passageway between the discharge zone and the suction zone of the compressor. The lead wires from the temperature sensor are wired in series with the normal motor temperature sensor circuit to provide the scroll discharge temperature control function as an integral part of the motor temperature control system located within the hermetic shell of the compressor. An additional embodiment of the present invention not only detects discharge gas temperatures but it also has the ability to detect the actual temperature of other selected compressor components.

13 Claims, 4 Drawing Sheets

SCROLL COMPRESSOR HAVING HIGH TEMPERATURE CONTROL

FIELD OF THE INVENTION

The present invention relates to scroll machines. More particularly, the present invention relates to scroll compressors having unique means for protecting the scroll machine from overheating.

BACKGROUND AND SUMMARY OF THE INVENTION

A typical scroll compressor has a first scroll member which has a spiral wrap located on one face thereof, a second scroll member which has a spiral wrap located on one face thereof with the spiral wraps of the scroll members being intermeshed with one another, and means for causing the first scroll member to rotate on a separate axis with respect to the second scroll member whereby the spiral wraps will create pockets of progressively decreasing volume from a suction zone to a discharge zone.

The means for causing the first scroll member to rotate on a separate axis with respect to the second scroll member is in many cases an electric motor. These electrical motors can be equipped with thermal protection devices to stop the operation of the motor when an over temperature condition exists. These thermal protection devices are normally a temperature sensor or sensors which are located within the proximity of the windings of the motor. When the temperature sensor or sensors encounter an over temperature condition, a signal is sent to a control device to stop the operation of the motor. On larger compressors or the higher horsepower compressors, three phase electrical current is supplied to the electric motor. For these three phase electrical compressors, a separate temperature sensor can be imbedded within the windings for each phase of current. These three temperature sensors are then wired in series such that any one of the individual phase windings could signal the control device to stop the operation of the motor due to an over temperature condition.

When solid state motor protection controls are employed, thermistors can be used for the temperature sensors. A thermistor is a resistive circuit component having a high positive temperature coefficient of resistance (as temperature increases, resistance also increases). The resistance of the thermistor or the series of thermistors is monitored by the solid state motor protection controls and upon reaching a threshold value, the controls will trip a relay to shut down the electrical motor and thus the compressor.

A typical scroll compressor, when operating, can generate excessively high discharge gas pressures due to the compressor functioning at a pressure ratio much greater than that which is designed into the machine in terms of its predetermined fixed volume ratio. These excessive discharge pressures can be caused by many different field encountered problems including loss of working fluid charge, blocked condenser fan in a refrigeration condition, or for a variety of other reasons. The excessively high discharge gas pressures will in turn cause excessively high discharge gas temperatures. If the compressor is allowed to continue to operate in these conditions, damage to the compressor will result.

Various prior art methods have been developed to monitor the temperature of the discharge gas and to shut the compressor down when excessive temperatures are encountered. These prior art methods include creating a leak from the high side of the compressor to the low side of the compressor of the high temperature discharge gas. This high temperature gas raises the temperature of the motor components including the standard type of thermal motor protectors described above which will then signal a control device to shut the motor down. Variations of the above designs include the incorporation of funnels or tubes to direct the high temperature discharge gas to specific motor components to improve the performance of the safety system. The problem associated with these designs is that there is an inherent delay in responding to the increase in discharge gas temperatures as the various motor components heat up sufficiently to cause the thermal motor protectors to signal the control device.

Another prior art method of monitoring the temperature of the discharge gas is to position a temperature sensor within the discharge area of the scroll compressor. The lead wires from this sensor are directed through the hermetic shell of the compressor to an outside control unit which will shut down the compressor when a specified discharge gas temperature is experienced. While this prior art method eliminates the inherent delay in the reaction to the increased gas discharge temperature, the penetration through the hermetic shell to provide access to the temperature sensor is a costly and troublesome design. The penetration of the shell requires additional sealing in order to maintain the integrity of the hermetic shell and once the temperature sensor's lead wires are outside the shell, additional control connections are required by the user.

Another prior art method of monitoring the temperature of the discharge gas is to position a temperature sensor on the exterior of the shell as close as possible to the discharge area of the scroll compressor. In order to position the sensor as close as possible to the discharge area, prior art compressor assemblies are provided with a deep drawn cup on the upper portion of the shell which extends into the discharge area. The temperature sensor is then positioned at the bottom of the deep drawn cup on the exterior of the shell. While this prior art design eliminates the need for additional penetration of the shell and shortens the delay in responding to the increase in discharge gas temperatures, there still is a significant amount of delay in responding to the higher temperatures due to the shell acting as a heat sink.

Accordingly, what is needed is a system for monitoring and reacting to the temperature of the discharge gas of a scroll machine which has the improved ability to track actual compressor temperatures. The system should not require any type of additional shell penetration or additional control connections by the user and should be manufacturable at a relatively low cost.

The present invention provides the art with a thermal protection system for a scroll machine which overcomes the above mentioned disadvantages of the prior art systems. The present invention comprises a temperature sensor which is positioned directly within the discharge port of the scroll compressor. The lead wires from the temperature sensor are wired in series with the normal motor temperature sensor circuit to provide the scroll discharge temperature control function as an integral part of the motor temperature control system located within the hermetic shell of the compressor. An additional embodiment of the present invention not only detects discharge gas temperatures but it also has the ability to detect the actual temperature of a selected compressor component. The present invention thus provides the improved ability to track actual scroll compressor temperatures and react to these temperatures without having the requirement of additional shell penetration and without requiring additional control connections by the user. The entire system is incorporated within the interior of the hermetically sealed shell at a relatively low cost.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 3 is an enlarged view of the highlighted area 3 in FIG. 1 showing the temperature sensor and the non-orbiting scroll of the compressor of the present invention.

DETAILED DESCRIPTION OF THE PREFERRED EMBODIMENTS

The present invention is suitable for incorporation in many different types of scroll machines. For exemplary purposes it will be described herein incorporated into a hermetic scroll refrigerant motor compressor of the type where the motor and the compressor are cooled by the suction gas within the hermetic shell as illustrated in the vertical section shown in FIG. 1.

Figure 1:
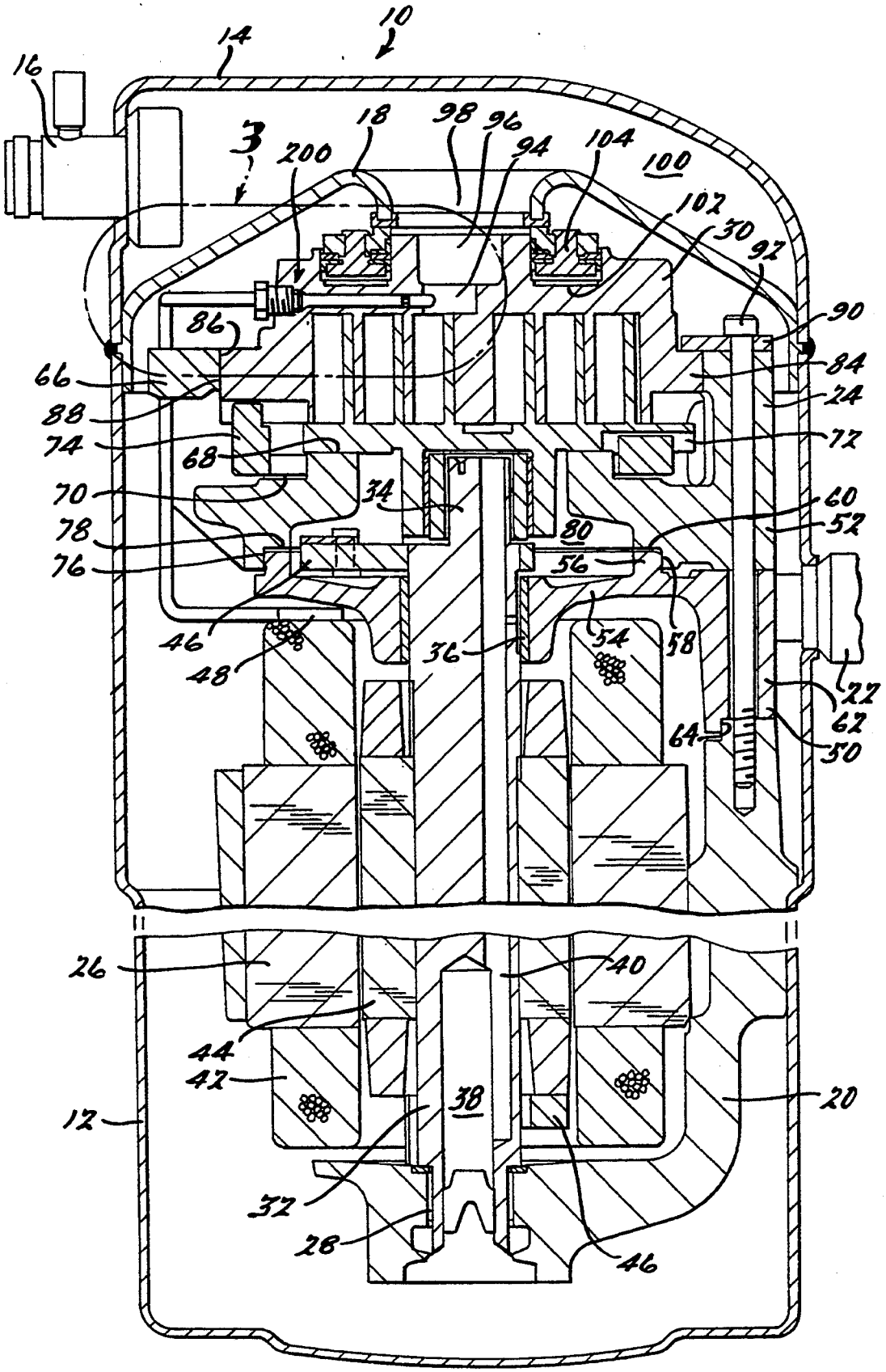
FIG. 1 is a vertical section view of a scroll compressor incorporating the thermal protection system of the present invention.
Figure 2:
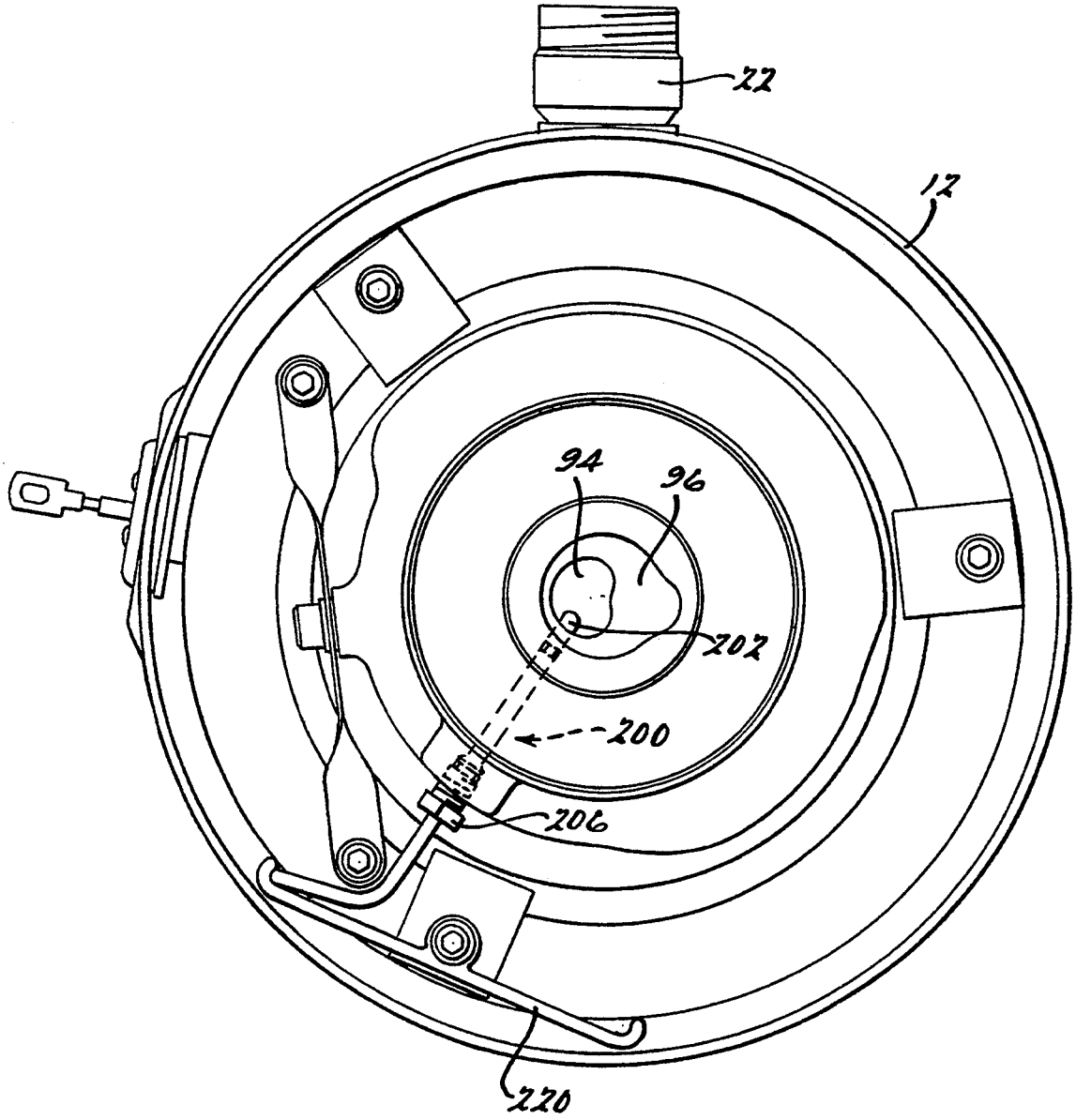
FIG. 2 is a plan view of the scroll compressor of FIG. 1 showing the location of the thermal protection system of the present invention.
Figure 2:
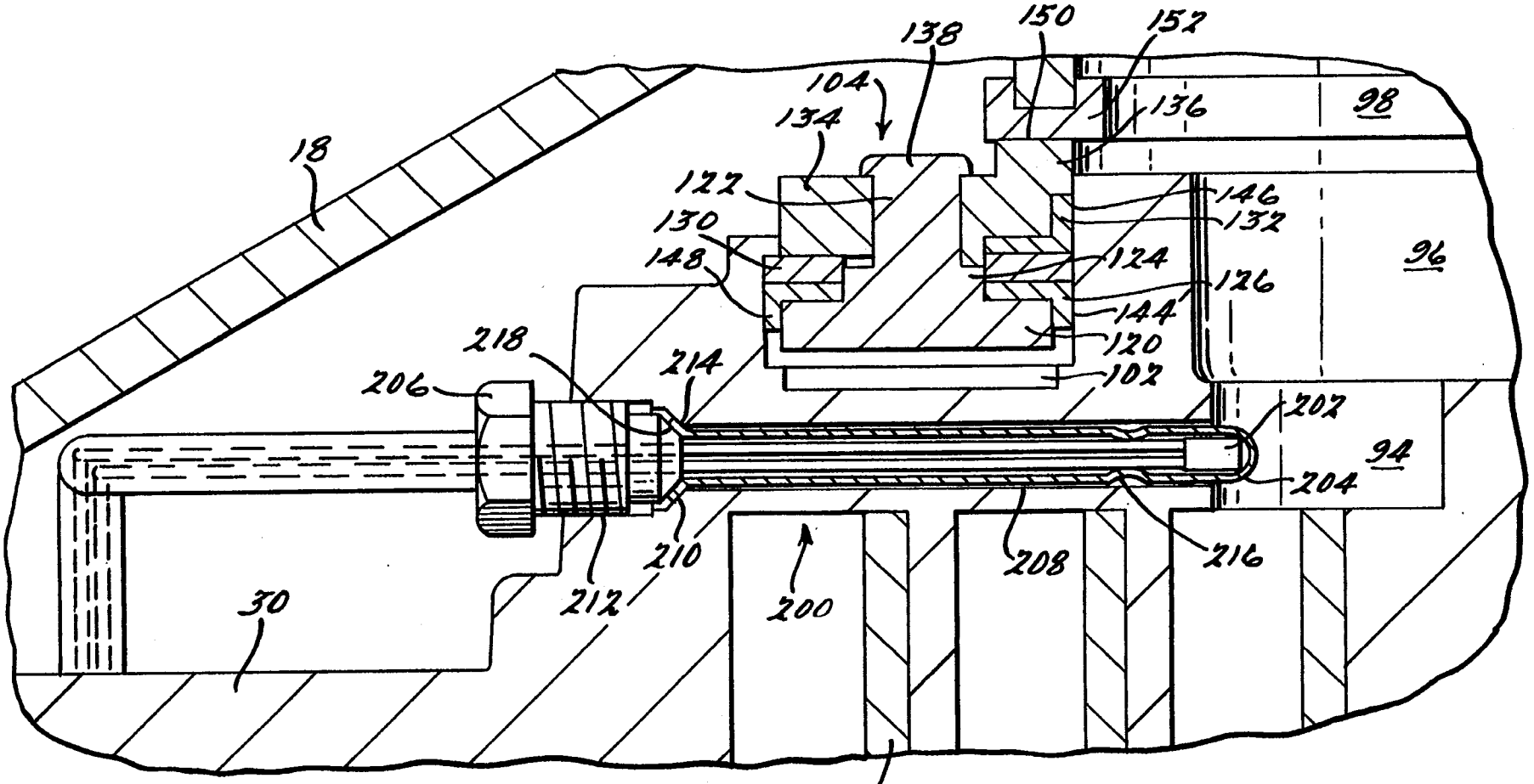

Referring now to the drawings in which like reference numerals designate like or corresponding parts throughout the several views, there is shown in FIGS. 1 through 3, a scroll compressor 10 incorporating the thermal protection system of the present invention. Compressor 10 comprises a cylindrical hermetic shell 12 having welded at the upper end thereof a cap 14. Cap 14 is provided with a refrigerant discharge fitting 16 optionally having the usual discharge valve therein (not shown). Other elements affixed to cylindrical shell 12 include a transversely extending partition 18 which is welded about its periphery at the same point cap 14 is welded to shell 12, a lower bearing housing 20 which is affixed to shell 12 at a plurality of points by methods known well in the art, and a suction gas inlet fitting 22.

Lower bearing housing 20 locates and supports within shell 12 a main bearing housing 24, a motor stator 26, a bearing 28 and a non-orbiting scroll member 30. A crankshaft 32 having an eccentric crank pin 34 at the upper end thereof is rotatably journaled in bearing 28 in lower bearing housing 20 and in a bearing 36 in main bearing housing 24. Crankshaft 32 has at its lower end the usual relatively large diameter oil-pumping concentric bore 38 which communicates with a smaller diameter inclined bore 40 extending upwardly therefrom to the top of crankshaft 32. The lower portion of cylindrical shell 12 is filled with lubricating oil in the usual manner and the pump at the bottom of the crankshaft is the primary pump acting in conjunction with bore 40 to pump lubricating fluid to all the various portions of the compressor which require lubrication.

Crankshaft 32 is rotatably driven by an electric motor including motor stator 26 having motor windings 42 passing therethrough, and a motor rotor 44 press fit on crankshaft 32 and having one or more counterweights 46. A temperature sensor 48 or a plurality of sensors 48, of the usual type, are provided in close proximity to motor windings 42 so that if motor windings 42 exceed a specified operating temperature, temperature sensor or sensors 48 will signal a control device (not shown) and de-energize the motor. When the electric motor is a three-phase electrical motor, a separate temperature sensor 48 may be provided in close proximity to the motor windings of each phase of electrical current. When the multiple temperature sensors 48 are wired in series, overheating of any one of the three phase windings can overheat the associated temperature sensor 48 causing the sensor to signal the control device and de-energize the motor. In the preferred embodiment, temperature sensors 48 are thermistors and the thermistor circuit is constantly monitored by a solid state motor protection control (not shown). Upon reaching a temperature threshold value, the thermistor will signal the solid state motor protection control which will trip a relay (not shown) and de-energize the electric motor.

Main bearing housing 24 includes a lower portion 50 and an upper portion 52. The lower portion 50 has a generally cylindrical shaped central portion 54 within which the upper end of crankshaft 32 is rotatably supported by means of bearing 36. An upstanding annular projection 56 is provided on lower portion 50 adjacent the outer periphery of central portion 54 and includes accurately machined radially outwardly facing surface and axially upwardly facing locating surface 58, 60 respectively. A plurality of radially circumferentially spaced supporting arms 62 extend generally radially outwardly from central portion 54 and include depending portions adapted to engage and be supported on lower bearing housing 20. A step 64 is provided on the terminal end of the depending portion of each of the supporting arms 62 which is designed to mate with a corresponding recess provided on the abutting portion of lower bearing housing 20 for aiding in radially positioned lower portion 50 with respect to lower bearing housing 20.

Upper portion 52 of main bearing housing 24 is generally cup-shaped including an upper annular guide ring portion 66 integrally formed therewith, an annular axial thrust bearing surface 68 disposed below ring portion 66, and a second annular supporting bearing surface 70 positioned below and in radially outwardly surrounding relationship to axial thrust bearing surface 68. Axial thrust bearing surface 68 serves to axially movably support an orbiting scroll member 72, and supporting bearing surface 70 provides support for an Oldham coupling 74. The lower end of upper portion 52 includes an annular recess defining radially inwardly and axially downwardly facing surfaces 76, 78 respectively which are designed to mate with surfaces 58 and 60 respectively of lower portion 50 to aid in axially and radially positioning upper and lower portions 50, 52 relative to each other. Additionally, a cavity 80 is designed to accommodate rotational movement of counterweight 46 secured to crankshaft 32 at the upper end thereof. The provision of this cavity enables counterweight 46 to be positioned in closer proximity to orbiting scroll member 72 thus enabling the overall size thereof to be reduced.

Annular integrally formed guide ring 66 is positioned in surrounding relationship to a radially outwardly extending flange portion 84 of non-orbiting scroll member 30 and includes a radially inwardly facing surface 86 adapted to slidingly abut a radially outwardly facing surface 88 of flange portion 84 so as to radially position and guide axial movement of non-orbiting scroll member 30. In order to limit the axial movement of non-orbiting scroll member 30 in a direction away from orbiting scroll member 72, a plurality of stop members 90 are provided which are secured to the top surface of annular ring 66 by bolts 92. Each of the stop members 90 includes a radially inwardly extending portion which is adapted to overlie an upper surface of flange portion 84 of non-orbiting scroll member 30 and cooperate therewith to limit axial upward movement of non-orbiting scroll member 30. Bolts 92 also serve to both secure upper and lower portions 50, 52 of main bearing assembly together as well as to secure this assembly to lower bearing housing 20. It should also be noted that the axial positioning of stop member 90 will be accurately controlled relative to the corresponding opposed surface of flange 84 to allow slight limited axial movement of non-orbiting scroll member 30. The scroll compressor as thus far described is further detailed in assignee's copending application Ser. No. 863,949 entitled "Non-Orbiting Scroll Mounting Arrangements for a Scroll Machine", filed Apr. 6, 1992, the disclosure of which is hereby incorporated by reference.

Non-orbiting scroll member 30 has a centrally disposed discharge passageway 94 communicating with an upwardly open recess 96 which is in fluid communication via an opening 98 in partition 18 with a discharge muffler chamber 100 defined by cap 14 and partition 18. Non-orbiting scroll member 30 has in the upper surface thereof an annular recess 102 having parallel coaxial side walls in which is sealingly disposed for relative axial movement an annular floating seal 104 which serves to isolate the bottom of recess 102 from the presence of gas under suction and discharge pressure so that it can be placed in fluid communication with a source of intermediate fluid pressure by means of a passageway (not shown). Non-orbiting scroll member 30 is thus axially biased against orbiting scroll member 72 by the forces created by discharge pressure acting on the central portion of non-orbiting scroll member 30 and those created by intermediate fluid pressure acting on the bottom of recess 102. This axial pressure biasing, as well as other various techniques for supporting scroll member 30 for limited axial movement, are disclosed in much greater detail in assignee's U.S. Pat. No. 4,877,382, the disclosure of which is hereby incorporated by reference.

Although the details of construction of floating seal 104 are not part of the present invention, for exemplary purposes seal 104 is of a coaxial sandwiched construction and comprises an annular base plate 120 having a plurality of equally spaced upstanding integral projections 122 each having an enlarged base portion 124. Disposed on plate 120 is an annular gasket 126 having a plurality of equally spaced holes which receive base portions 124, on top of which is disposed an annular spacer plate 130 having a plurality of equally spaced holes which receive base portions 124, and on top of plate 130 is an annular gasket 132 maintained in coaxial position by means of an annular upper seal plate 134 having a plurality of equally spaced holes receiving projections 122. Seal plate 134 has disposed about the inner periphery thereof an upwardly projecting planar sealing lip 136. The assembly is secured together by swaging the ends of each of the projections 122, as indicated at 138.

The overall seal assembly therefor provides three distinct seals; namely, an inside diameter seat at 144 and 146, an outside diameter seal at 148 and a top seal at 150, at best seen in FIG. 3. Seal 144 is between the inner periphery of annular gasket 126 and the inside wall of recess 102, and seal 146 is between the inner periphery of annular gasket 132 and the inside wall of recess 102. Seals 144 and 146 isolate fluid under intermediate pressure in the bottom of recess 102 from fluid under discharge pressure in recess 98. Seal 148 is between the outer periphery of annular gasket 126 and the outer wall of recess 102 and isolates fluid under intermediate pressure in the bottom of recess 102 from fluid at suction pressure within shell 12. Seal 150 is between sealing lip 136 and an annular wear ring 152 surrounding opening 98 in partition 18, and isolates fluid at suction pressure from fluid at discharge pressure across the top of the seal assembly. Details of additional seal constructions are more fully described in applicant's assignee's U.S. Pat. No. 5,156,539, the disclosure of which is hereby incorporated herein by reference.

Relative rotation of the scroll members is preferably prevented by the usual Oldham coupling of the type disclosed in the above referenced Pat. No. 4,877,382, however, the coupling disclosed in assignee's copending application Ser. No. 591,443 entitled "Oldham Coupling for Scroll Compressor" filed Oct. 1, 1990, U.S. Pat. No. 5,320,506, the disclosure of which is hereby incorporated by reference, may be used in place thereof.

The compressor is preferably of the "low side" type in which suction gas entering via gas inlet 22 is allowed, in part, to escape into shell 12 and assist in cooling the motor. So long as there is an adequate flow of returning suction gas the motor will remain within desired temperature limits. When this flow drops significantly, however, the loss of cooling will eventually cause temperature sensor or sensors 48 to signal the control device and shut the machine down.

The scroll compressor as thus far broadly described is either now known in the art or is the subject matter of other pending applications for patent by applicant's assignee. The details of construction which incorporate the principles of the present invention are those which deal with a unique thermal protection system, indicated generally at 200.

The thermal protection system 200 of the present application shown in FIGS. 1 through 3 is located within non-orbiting scroll 30 and comprises a temperature sensor 202, a sensor tube 204 and a flared connector 206. Non-orbiting scroll 30 has a longitudinally extending through passageway 208 which extends from the outer diameter of non-orbiting scroll 30 to discharge passageway 94. The end of passageway 208 opposite to discharge passageway 94 is provided with a flared sealing seat 210 and an internal threaded diameter 212. Sensor tube 204 is a hollow cylindrical tube which is closed at one end and has an open flared end 214 opposite to the closed end. Sensor tube 204 is inserted into passageway 208 such that the closed end of tube 204 extends into discharge passageway 94 and the outside surface of flared end 214 rests against sealing seat 210.

Temperature sensor 202 is inserted into hollow cylindrical tube 204 such that the sensing end of sensor 202 is positioned at the closed end of tube 204 which is located within discharge passageway 94. Sensor tube 204 may be rolled as shown at 216 to aid in the retention of sensor 202 if desired. The lead wires extending from the sensing end of sensor 202 are fed through flared connector 206 and flared connector 206 is threadingly received in threaded diameter 212 of passageway 208. Upon tightening of flared connector 206, a chamfered surface 218 on connector 206 engages the interior surface of flared end 214 of sensor tube 204. Continued tightening of flared connector 206 will compress flared end 214 of sensor tube 204 between chamfered surface 218 of flared connector 206 and sealing seat 210 of non-orbiting scroll 30 creating a fluid seal between the high discharge side and the low pressure suction side of compressor 10. Flared connector 206 also aids in the retention of sensor 202. The lead wires extending from the sensing end of sensor 202 are routed around and through the various internal components of compressor 10 and are mated with the thermal protection circuit containing temperature sensor or sensors 48. A clip 220 may be employed to insure that the lead wires are held in position and not damaged by the welding or operation of compressor 10.

Temperature sensor 202 is wired in series with temperature sensor or sensors 48 such that the motor will be de-energized by the control device when either an excessive discharge gas temperature is sensed by sensor 202 or by a motor winding overheating condition which is sensed by temperature sensor or sensors 48. When solid state motor protection controls are used to monitor the operating conditions of compressor 10, temperature sensor 202 is preferably a thermistor similar to those described above for temperature sensor 48.

While the above preferred embodiment has described the temperature sensing of the discharge gas and integrating the temperature sensing with the thermal protection system of the electric motor, it is within the scope of the present invention to sense other operating characteristics of compressor 10 to provide an indication of the operating condition of compressor 10 and integrate this sensing with the thermal motor protection circuit. Other operating characteristics which could be monitored include the actual temperature of non-orbiting scroll member 30, the actual pressure within discharge muffler chamber 100 or various other operating characteristics.

Figure 4:
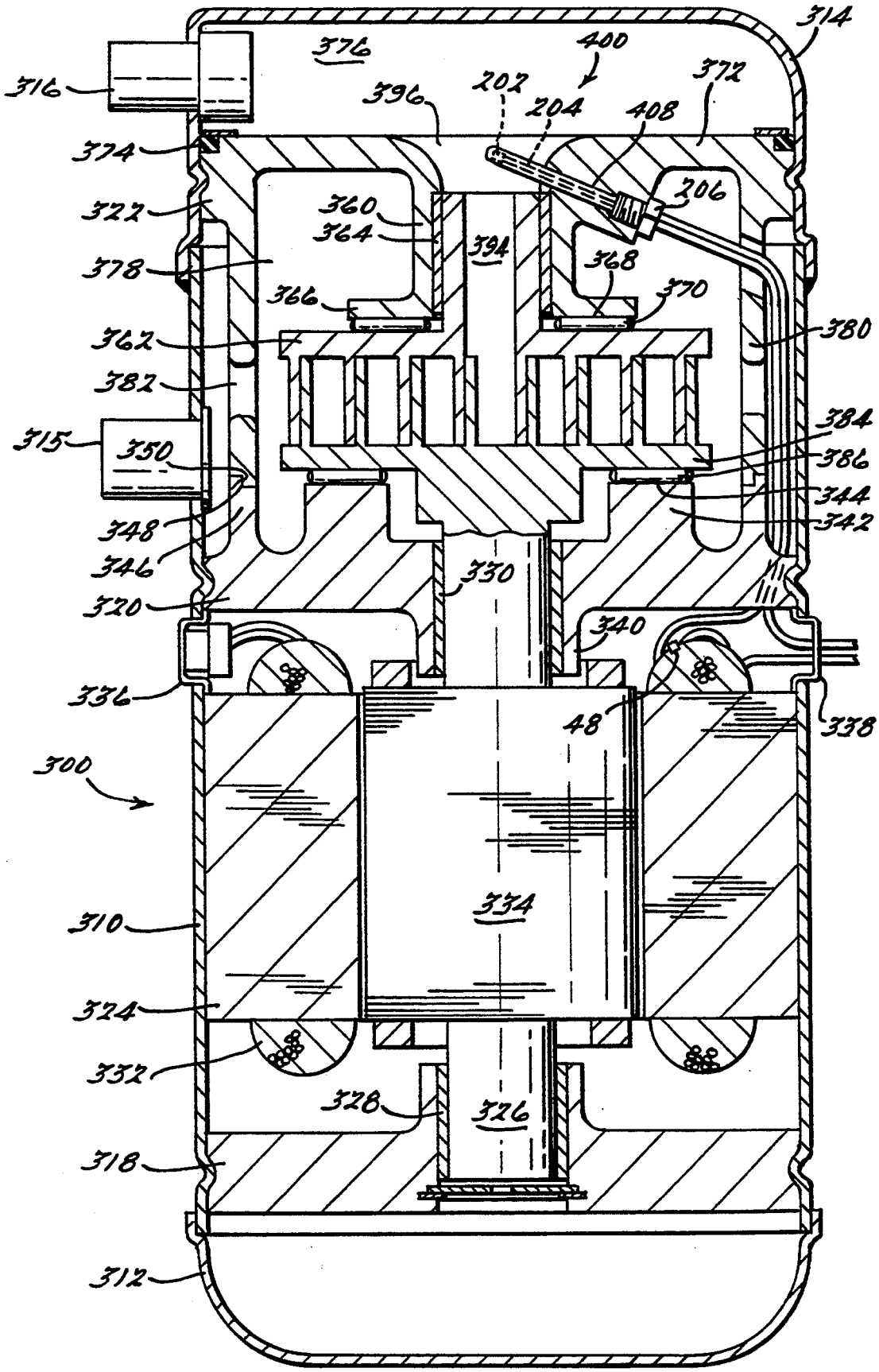
FIG. 4 is a schematic view of a scroll compressor incorporating the thermal protection system according to another embodiment of the present invention.

Referring now to FIG. 4, there is shown a scroll compressor 300 incorporating the thermal protection system of the present invention. Compressor 300 comprises a cylindrical hermetic shell 310 having welded at the lower end thereof a cover 312 and at the upper end thereof a cap 314. Cap 314 is provided with a refrigerant discharge fitting 316 optionally having the usual discharge valve therein (not shown). Other members affixed within the hermetic shell formed by shell 310, cover 312 and cap 314 include a suction gas inlet fitting 315, a lower bearing housing 318, an intermediate bearing housing 320, an upper bearing housing 322 and a motor stator 324. Lower bearing housing 3 18 is affixed to shell 3 10 at its outer periphery by methods known well in the art.

A crankshaft 326 is rotatably journaled in a bearing 328 located in lower bearing housing 318 and in a bearing 330 located in intermediate bearing housing 320. Similar to the compressor shown in FIG. 1, crankshaft 326 has the usual oil pumping bores (not shown) and the lower portion of cylindrical shell 310 is filled with lubricating oil in the usual manner and the pump located within crankshaft 326 is the primary pump which pumps lubricating fluid to all the various portions of compressor 300 which require lubrication.

Crankshaft 326 is rotatably driven by an electric motor including motor stator 324 having motor windings 332 passing therethrough, and a motor rotor 334 press fit on crankshaft 326. Power to the motor is supplied by a connector 336. Temperature sensor 48, or a plurality of sensors 48, of the usual type, are provided in close proximity to motor windings 332 so that if motor windings 332 exceed a specified operating temperature, temperature sensor or sensors 48 will signal a control device (not shown) and de-energize the motor. When the electric motor is a three-phase electrical motor, a separate temperature sensor 48 may be provided in close proximity to the motor windings of each phase of electrical current. When these multiple temperature sensors 48 are wired in series, overheating of any one of the three phase windings can overheat the associated temperature sensor 48 causing the sensor to signal the control device and de-energize the motor. In the preferred embodiment, temperature sensors 48 are thermistors and the thermistor circuit is constantly monitored by a solid state motor protection control (not shown). Upon reaching a temperature threshold value, the thermistor will signal the solid state motor protection control which will trip a relay (not shown) and de-energize the electric motor. Electrical access to temperature sensors 48 is provided by connector 338.

Intermediate bearing housing 320 has a generally cylindrical shaped central portion 340 within which the upper end of crankshaft 326 is rotatably supported by bearing 330. An upstanding annular projection 342 is provided on intermediate bearing housing 320 adjacent the outer periphery of central portion 340 and includes upwardly facing bearing surface 344. An annular section 346 extends generally radially outwardly from annular projection 342 and includes a step 348 which is designed to mate with a corresponding step 350 provided on upper bearing housing 322 for aiding in radially positioning upper bearing housing 322 with respect to intermediate bearing housing 320. The exterior surface of annular section 346 is adapted for mating with shell 3 10 to fixedly secure intermediate bearing housing 320 within shell 310 by methods well known in the art.

Upper bearing housing 322 has a generally cylindrical shaped central portion 360 within which an upper scroll member 362 is rotatably supported by a bearing 364. An annular flange 366 extends radially outward from the lower end of central portion 360 to provide a bearing surface 368 for upper scroll member 362. A bearing 370 is positioned between bearing surface 368 and upper scroll member 362. An annular wall 372 extends radially outward from the upper end of central portion 360 and is fixedly secured at its periphery to shell 310 by means known well in the art. A seal 374 seals the upper discharge zone 376 from the lower suction zone 378. A generally cylindrical section 380 extends downward from annular wall 372 and includes step 350 which matingly engages step 348. A plurality of apertures 382 are provided through cylindrical section 380 to allow gas at suction pressure to enter the compressor section.

A lower scroll 384 is fixedly secured for rotation to crankshaft 326 and is supported on bearing surface 344 by a bearing 386. Lower scroll 384 is intermeshed with upper scroll 362 and both upper and lower scrolls 382 and 384 rotate together, but on different axes, whereby the spiral wraps will create pockets of progressively decreasing volume from suction zone 378 to discharge zone 376. Upper scroll 362 has a centrally disposed discharge passageway 394 communicating with discharge zone 376 through an opening 396 in upper bearing housing 322.

The scroll compressor as thus far broadly described is either now known in the art or is the subject matter of other pending applications for patent by applicant's assignee. The details of construction which incorporate the principles of the present invention are those which deal with a unique thermal protection system, indicated generally at 400.

The thermal protection system 400 of the present invention is identical to o thermal protection system 200 except access to discharge passageway 394 is provided by a longitudinally extending through passageway 408 which extends through upper bearing housing 322. Thermal protection system 400 also includes temperature sensor 202, sensor tube 204 and flare connector 206 identical to that shown in FIG. 3 including the insertion of tube 204 into passageway 408 and the sealing between discharge zone 376 and suction zone 378 by flared connector 206 in conjunction with tube 204 and passageway 408.

The lead wires extending from the sensor end of sensor 202 are routed around and through the various internal components of compressor 300 and are mated with the thermal protection circuit containing temperature sensor or sensors 48.

Temperature sensor 202 is wired in series with temperature sensor or sensors 48 such that the motor will be de-energized by the control device when either an excessive discharge gas temperature is sensed by sensor 202 or by a motor winding overheating condition which is sensed by temperature sensor or sensors 48. When solid state motor protection controls are used to monitor the operating conditions of compressor 300, temperature sensor 202 is preferably a thermistor similar to those described above for temperature sensor 48.

While the above preferred embodiment has described the temperature sensing of the discharge gas and integrating the temperature sensing with the thermal protection system of the electric motor, it is within the scope of the present invention to sense other operating characteristics of compressor 300 to provide an indication of the operating condition of compressor 300 and integrate this sensing with the thermal motor protection circuit. Other operating characteristics which could be monitored include the actual temperature of upper bearing housing 322, the actual pressure within discharge zone 376 or various other operating characteristics.

While the above detailed description describes the preferred embodiment of the present invention, it should be understood that the present invention is susceptible to modification, variation and alteration without deviating from the scope and fair meaning of the subjoined claims.

What is claimed is:

1. A scroll compressor comprising:

(a) a hermetic shell having a motor cavity;

(b) a first scroll member in said shell and having a first spiral wrap on one face thereof;

(c) a second scroll member disposed in said shell and having a second spiral wrap on one face thereof, said wraps being intermeshed with one another;

(d) a motor disposed in said motor cavity of said shell for causing said wraps of said first scroll member to move with respect to said wraps of said second scroll member whereby said wraps will create pockets of progressively decreasing volume from a suction zone at suction pressure to a discharge zone at discharge pressure, said second scroll member defining a discharge passage;

(e) means for introducing suction gas into said shell;

(f) first means for de-energizing said motor when said motor reaches a predetermined temperature, said first means de-energizing said motor disposed within said hermetic shell; and (g) second means for de-energizing said motor, said second means for de-energizing said motor disposed within said discharge passage and operable to de-energize said motor upon sensing an undesirable operating condition of said compressor, said second means for de-energizing said motor being disposed within said hermetic shell connected in series with said first means for de-energizing said motor, said second scroll member defining a passageway beginning in said discharge passage and extending to the outer periphery of said second scroll member, said second means for de-energizing said motor extending through said passageway.

2. A scroll compressor as claimed in claim 1 wherein said first scroll member is an orbiting scroll, said second scroll member is a non-orbiting scroll and said motor causes said orbiting scroll to orbit about an axis with respect to said non-orbiting scroll member.

3. A scroll compressor as claimed in claim 1 wherein said first scroll rotates about a first axis and said second scroll rotates about a second axis, said first axis being offset from said second axis.

4. A scroll compressor as claimed in claim 1 Wherein said second means for de-energizing said motor is a thermal responsive protector disposed within said discharge zone.

5. A scroll compressor as claimed in claim 4 wherein said thermal responsive protector comprises a thermistor.

6. A scroll compressor comprising:

(a) a hermetic shell having a motor cavity;

(b) an orbiting scroll member disposed in said shell and having a first spiral wrap on one face thereof;

(c) a non-orbiting scroll member disposed in said shell and having a second spiral wrap on one face thereof, said wraps being intermeshed with one another;

(d) a motor disposed in said motor cavity of said shell for causing said orbiting scroll member to orbit around an axis with respect to said non-orbiting scroll member whereby said wraps will create pockets of progressively decreasing volume from a suction zone at suction pressure to a discharge zone at discharge pressure, said non-orbiting scroll member defining a discharge passage through said non-orbiting scroll member through which compressed gas exits said pockets at the end of each compression cycle;

(e) means for introducing suction gas into said shell;

(f) first means for de-energizing said motor when said motor reaches a predetermined temperature; and (g) second means for de-energizing said motor, said second means for de-energizing said motor disposed within said discharge passage and operable to de-energize said motor upon sensing an undesirable operating condition of said compressor, said second means for de-energizing said motor being connected in series with said first means for de-energizing said motor, said non-orbiting scroll defining a passageway beginning in said discharge passage and extending to the outer periphery of said non- orbiting scroll, said second means for de-energizing said motor extending through said passageway.

7. A scroll compressor as claimed in claim 6 further comprising:

a sensor tube disposed within said passageway, said second means for de-energizing said motor being disposed within said sensor tube; and a fitting fixedly received within said passageway, said fitting operable to compress said sensor tube between said fitting and said non-orbiting scroll to seal said discharge zone from said suction zone.

8. A scroll compressor as claimed in claim 7 wherein said second means for de-energizing said motor is a thermal responsive protector disposed within said sensor tube.

9. A scroll compressor as claimed in claim 8 wherein said thermal responsive protector comprises a thermistor.

10. A scroll compressor comprising:

(a) a hermetic shell having a motor cavity;

(b) a first scroll member disposed in said shell and having a first spiral wrap on one face thereof;

(c) a second scroll member disposed in said shell and having a second spiral wrap on one face thereof, said wraps being intermeshed with one another;

(d) a motor disposed in said motor cavity of said shell for causing said wraps of said first scroll member to move with respect to said wraps of said second scroll member whereby said wraps will create pockets of progressively decreasing volume from a suction zone at suction pressure to a discharge zone at discharge pressure, said second scroll member being rotatably mounted in a housing, said housing defining a passageway beginning in said discharge zone and extending generally to the outer periphery of said housing to said suction zone;

(e) means for introducing suction gas into said shell;

(f) first means for de-energizing said motor when said motor reaches a predetermined temperature; and (g) second means for de-energizing said motor, said second means for de-energizing said motor extending through said passageway in said housing and operable to de-energize said motor upon sensing an undesirable operating condition of said compressor, said second means for de-energizing said motor being connected in series with said first means for de-energizing said motor.

11. A scroll compressor as claimed in claim 10 further comprising:

a sensor tube disposed within said passageway, said second means for de-energizing said motor being disposed within said sensor tube; and a fitting fixedly received within said passageway, said fitting operable to compress said sensor tube between said fitting and said housing to seal and discharge zone from said suction zone.

12. A scroll compressor as claimed in claim 11 wherein said second means for de-energizing said motor is a thermal responsive protector disposed within said sensor tube.

13. A scroll compressor as claimed in claim 12 wherein said thermal responsive protector comprises a thermistor.

* * * * *

UNITED STATES PATENT AND TRADEMARK OFFICE

CERTIFICATE OF CORRECTION

PATENT NO. : 5,368,446

DATED : November 29, 1994

INVENTOR(S) : Donald W. Rode

It is certified that error appears in the above-indentified patent and that said Letters Patent is hereby corrected as shown below:

Column 6, line 11, "at" should be — as —.

Column 7, line 62, "3 18" should be -- 318 —.

Column 7, line 63, "3 10" should be — 310 —.

Column 8, line 47, "3 10" should be -- 310 —.

Column 9, line 17, delete — o —.

Column 9, line 64, after "member" insert — disposed —.

Column 10, line 36, "Wherein" should be -- wherein —.

Column 10, line 39, "zone" should be -- passage --.

Column 11, line 7, "non-orbiting" should be — non-orbiting —.

Column 12, line 27, "and" should be — said —.

Signed and Sealed this

Twentieth Day of June, 1995

*Attest:*

*Attesting Officer*

BRUCE LEHMAN

*Commissioner of Patents and Trademarks*